United States Patent [19]

Campau

[11] 3,989,248

[45] Nov. 2, 1976

[54] GOLF CLUB HAVING INSERT CAPABLE OF ELASTIC FLEXING

[75] Inventor: Daniel N. Campau, Hanover Park, Ill.

[73] Assignee: Pepsico, Inc., Purchase, N.Y.

[22] Filed: Feb. 20, 1976

[21] Appl. No.: 659,939

Related U.S. Application Data

[63] Continuation-in-part of Ser. No. 536,431, Dec. 26, 1974, abandoned.

[52] U.S. Cl. ..... 273/78; 273/173

[51] Int. Cl.[2] ..... A63B 53/08

[58] Field of Search ..... 273/77 R, 78, 167–175

[56] References Cited

UNITED STATES PATENTS

| | | | |
|---|---|---|---|
| 550,976 | 12/1895 | Jennings | 273/78 |
| 699,624 | 5/1902 | Kempshall | 273/78 |
| 700,946 | 5/1902 | Kempshall | 273/78 |
| 708,575 | 9/1902 | Mules | 273/78 |
| 777,400 | 12/1904 | Clark | 273/78 |
| 1,154,490 | 9/1915 | Davis | 273/78 |
| 1,359,220 | 11/1920 | Beamer | 273/78 |
| 1,854,548 | 4/1932 | Hunt | 273/78 |
| 2,034,936 | 3/1936 | Barnhart | 273/78 |
| 2,040,252 | 5/1936 | Farrington | 273/78 |
| 2,756,055 | 7/1956 | Bittner | 273/171 |
| 2,846,228 | 8/1958 | Reach | 273/169 |
| 3,061,310 | 10/1962 | Giza | 273/78 |
| 3,233,905 | 2/1966 | Flom | 273/173 |
| 3,387,844 | 6/1968 | Shippee | 273/78 X |
| 3,578,332 | 5/1971 | Caldwell | 273/78 X |
| 3,834,700 | 9/1974 | Averbach | 273/173 X |
| 3,847,399 | 11/1974 | Raymont | 273/167 F |
| 3,863,932 | 2/1975 | Lezatte | 273/173 X |
| 3,888,492 | 6/1975 | Cabot | 273/78 X |

FOREIGN PATENTS OR APPLICATIONS

| | | | |
|---|---|---|---|
| 646,942 | 8/1962 | Canada | 273/78 |
| 3,822 | 2/1893 | United Kingdom | 273/78 |
| 1,554 | 1/1895 | United Kingdom | 273/78 |
| 18,134 | 8/1902 | United Kingdom | 273/78 |
| 23,750 | 11/1905 | United Kingdom | 273/78 |
| 379,032 | 8/1932 | United Kingdom | 273/78 |
| 1,192,139 | 5/1970 | United Kingdom | 273/78 |

*Primary Examiner*—Richard J. Apley
*Attorney, Agent, or Firm*—Hill, Gross, Simpson, Van Santen, Steadman, Chiara & Simpson

[57] ABSTRACT

A golf club of the wood type in which the ball striking surface of the head is recessed to receive a metal insert which is secured therein, the insert having a front grooved surface which is flush with and forms a part of the striking surface of the club, the insert having an open-ended passageway extending therethrough from top to bottom so that the front grooved surface is capable of elastic flexing relative to the remainder of the insert.

9 Claims, 5 Drawing Figures

Fig. 2
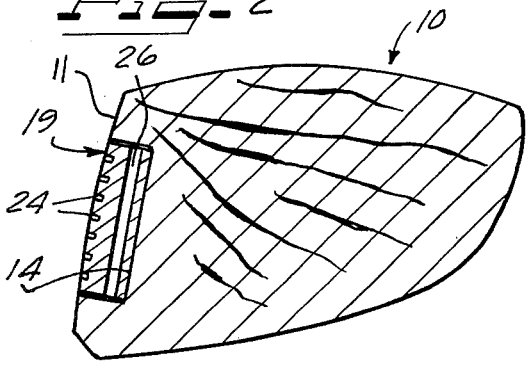
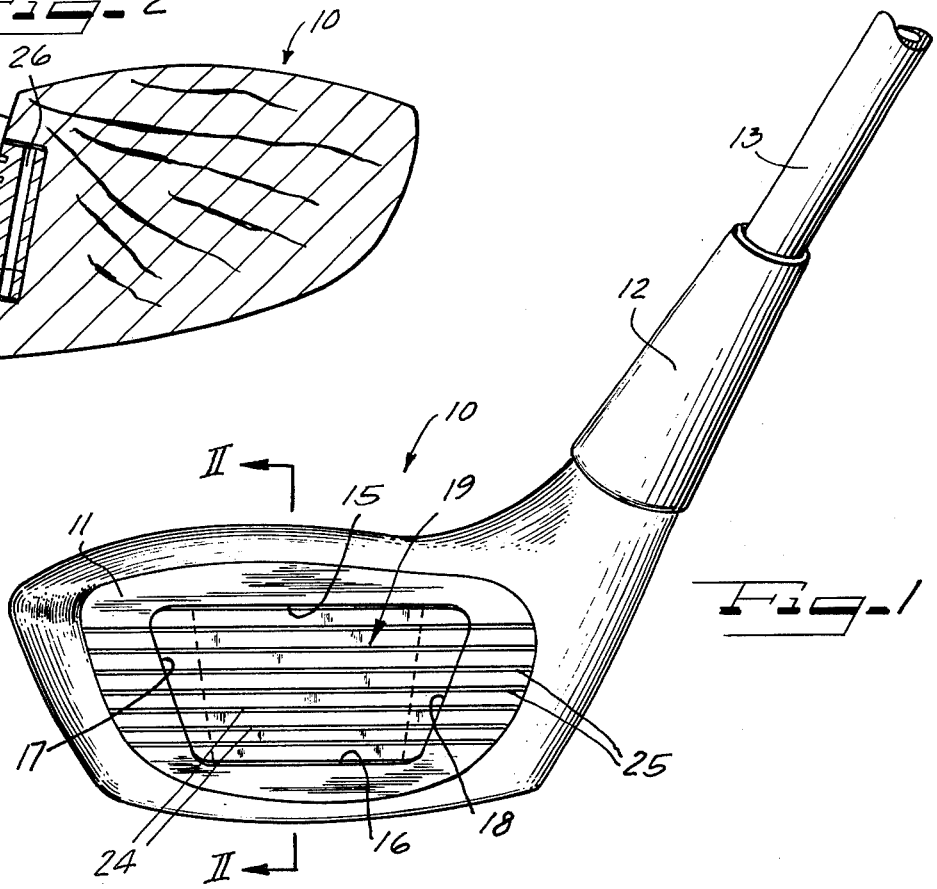
Fig. 1
Fig. 3
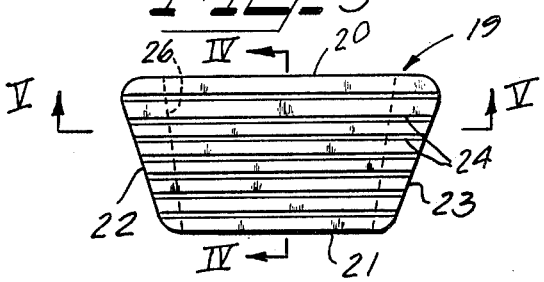
Fig. 4
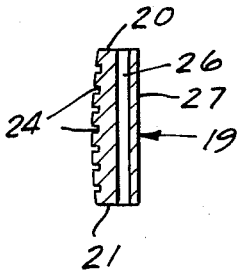
Fig. 5
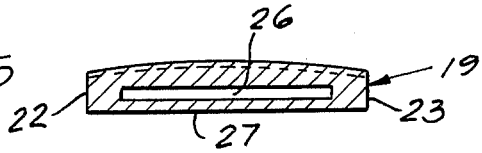

GOLF CLUB HAVING INSERT CAPABLE OF ELASTIC FLEXING

REFERENCE TO RELATED APPLICATION

This application is a continuation-in-part of my Ser. No. 536,431 filed Dec. 26, 1974, now abandoned.

BACKGROUND OF THE INVENTION

1. Field of the Invention

This invention is in the field of wood-type golf clubs having an insert in the striking face thereof, the insert being composed of a high yield strength metal and being configured such that the front face of the insert is capable of elastic flexing.

2. Description of the Prior Art

The patented prior art contains numerous disclosures of various materials suitable for use as inserts in the striking face of a wood golf club. U.S. Pat. No. 699,624 to Kempshall describes a wood golf club having a facing composed of celluloid and a fabric, the celluloid being impregnated into the fabric. The theory of this patent was that the celluloid was sufficiently hard not to be pitted or injured by impact of the ball and yet was elastic.

Thompson et al. U.S. Pat. No. 838,284 described a golf club in which the head was formed of a metal casting which was filled with a resilient material such as rubber, the striking face of the head being cut away to expose the rubber filler.

Beamer U.S. Pat. No. 1,359,220 described a golf club having a metallic striking plate fitted into a recess in the club face and wall portions extending rearwardly from the edges of the face, the plate being spaced from the rear wall of the depression so that it is free to vibrate.

Farrington U.S. Pat. No. 2,040,252 described an insert for a wood-type club using a perforated plate in combination with a metal abutment behind the plate which was received within a recess.

Baker et al. U.S. Pat. No. 3,172,667 assigned to a predecessor of the assignee of the present application described a golf club head which eliminated the need for screws on the striking face. This patent described a club in which the face inserts were molded in place, the inserts consisting of synthetic resins such as epoxy, polyester or polyamide resins.

Burr U.S. Pat. No. 3,218,072 described a golf club which had impact receiving faces formed of blocks or inserts composed of hard, porous carbon. These inserts were said to have relatively high resilience per unit of volume and appreciable compressibility under moderate stress. These characteristics made it possible to secure the inserts in the club head solely by the expansive thrust of the insert against the walls of the recesses in which they were placed, making adhesives or other securing devices unnecessary.

Flom U.S. Pat. No. 3,233,905 suggested a golf club having an impact face composed of a polycarbonate resin. Such inserts were said to exhibit dynamic losses over a wide range of temperatures which were much lower than those of other thermoplastic materials.

Lynn U.S. Pat. No. 3,567,228 suggested a golf club striking face which included an insert having a very high modulus of elasticity, typically on the order of 28,000,000 pounds per square inch, and more. The use of such high modulus metal inserts was said to minimize deflection thereby reducing the amount of energy which was capable of being absorbed and wasted within the club head.

Averbach U.S. Pat. No. 3,834,700 also taught the use of a high modulus insert and correlated this to a weight distribution such that the assembled golf club had a ratio of gross weight to swing weight which is less than 0.62.

Dance U.S. Pat. No. 3,836,153 described a golf club utilizing an insert composed of a molded piece prepared by curing a suspension polymerized polymethyl methacrylate powder containing a graft copolymer of butadiene and styrene in a liquid containing methyl methacrylate and glycol methacrylate as cross-linking monomers. The objective of this patent was to provide an insert which provided a better "click" and "feel" than in other plastic type inserts.

The prior art has thus disclosed many different types of insert materials for use in golf clubs, based upon varying considerations. The present invention is directed to an improved type of insert having a structural configuration which is different from the above prior art and provides an insert which is capable of elastic flexing and which can be manufactured and assembled more simply than other types of inserts.

SUMMARY OF THE INVENTION

The present invention provides an improved golf club of the wood type in which a conventional wooden head which has the usual striking face on its front surface is provided with a recess, and a polygonal metal insert having parallel, substantially horizontal upper and lower edges is received within the insert and adhesively secured therein. The outer face of the insert is grooved to form at least a portion of the striking face of the club. The insert is composed of a metal having a yield strength of at least 150,000 pounds per square inch, and has a hollow interior extending the full vertical dimension of the insert. The upper and lower edges of the insert are preferably spaced slightly from the upper and lower walls which define the recess. This type of insert provides an integral support structure allowing all the flexural stresses to be taken internally of the insert itself. The insert can be adhesively secured into the head cavity of the wooden club with or without the use of attachment screws. The metal of the insert is relatively dense, thereby moving the center of gravity of the club head more toward the face of the club. This provides a better degree of club control as compared with clubs having conventional inserts.

The inserts of the present invention are definite improvements over totally rigid inserts in that such rigid inserts flex the ball only. Any inefficient flexing of the ball dissipates energy in the yielding of the ball upon impact. In contrast, the elastically flexible insert of the present invention flexes at impact, spreading out the impact force over a larger area, thereby tending to reduce local stresses in the ball winding and its cover. The elastic flexing also tends to give a longer duration of impact. The improved insert of the present invention also has a high natural frequency of vibration, so that the period of vibration is short. This low period of vibration of the face causes the club head to release its stored energy more efficiently into the ball.

The use of various synthetic resins in golf club inserts also is undesirable because such synthetic resin materials exhibit more compression than a metal, causing losses due to hysteresis. The insert of the present invention, which is made of metal, minimizes such losses.

The insert of the present invention conserves strain energy but returns quickly enough to transfer more energy into the ball. In contrast, totally rigid inserts provide uncontrolled shock which is not efficiently returned to the ball.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a fragmentary view in elevation of a golf club head embodying the improvements of the present invention;

FIG. 2 is a cross-sectional view taken substantially along the line II—II of FIG. 1;

FIG. 3 is a front elevational view of the insert itself;

FIG. 4 is a cross-sectional view taken substantially along the line IV—IV of FIG. 3; and FIG. 5 is a cross-sectional view taken substantially along the line V—V of FIG. 3.

DESCRIPTION OF THE PREFERRED EMBODIMENTS

In FIG. 1, reference numeral 10 indicates generally a golf club of the wood type, a ball striking face 11, a hosel 12 and a shaft 13. The striking face 11 is generally spherical in the horizontal plane, with a radius of curvature of about 9½ inches or so.

The striking face 11 of the club is provided with a polygonal recess 14 including a substantially horizontal upper wall 15, a substantially horizontal lower wall 16 and angularly disposed side walls 17 and 18 as best seen in FIG. 1. A metal insert generally indicated at 19 is arranged to be received within the recess 14 and to be adhesively secured therein. As best seen in FIG. 3, the insert 19 includes parallel top and bottom surfaces 20 and 21 and angularly disposed side surfaces 22 and 23 which are shaped complementary to the recess 14 in the club head. The upper surface 20 and the lower surface 21, however, are spaced from the corresponding wall portions 15 and 16 by a slight amount to facilitate flexing of the insert.

The insert 19 is composed of a metal which has a yield strength of at least 150,000 pounds per square inch. Many different types of metals and metal alloys can be used for this purpose, but I prefer to use either a precipitation hardening stainless steel, or a beryllium-copper alloy. One suitable precipitation hardening stainless steel is that identified as "17-4PH" which has a nominal composition containing 0.04% carbon, 0.40% manganese, 0.50% silicon, 16.5% chromium, 4.25% nickel, 0.25% columbium, 3.6% copper, the balance iron. Among the beryllium-copper alloys which can be used are those containing about 2% beryllium, 0.25% cobalt or 0.35% nickel, with the balance being copper.

The insert 19 is provided with horizontally extending grooves 24 which are in registry with corresponding grooves 25 formed in the face of the club itself. The insert forms smooth continuation of the striking face of the club, having a radius of curvature of about 9½ inches.

As best seen in FIGS. 4 and 5, the insert 19 has a hollow interior represented by a passageway 26 having a generally rectangular cross-section in a horizontal plane. The passageway 26 extends all the way from the bottom surface 21 to the top surface 20 of the insert. Such inserts may be conveniently formed by investment casting procedures utilizing a suitable core material to provide the passage 26.

The rear surface of the insert 19, identified at reference numeral 27 is adhesively secured to the back wall of the recess 14 by means of a suitable adhesive such as an epoxy resin. This eliminates the necessity for using attachment screws.

The new insert provides integral support structure which allows all the flexural stresses to be taken internal to the insert itself. A typical insert weighs about 1⅝ ounces. This relatively dense insert causes the center of gravity of the club to move more toward the face of the club thereby improving club control as compared with clubs containing conventional inserts.

It should be evident that various modifications can be made to the described embodiments without departing from the scope of the present invention.

I claim as my invention:

1. A gold club of the wood type comprising a relatively massive enlarged head having a ball striking surface, said surface having a recess therein, and a metal insert secured within said recess and having a front grooved surface forming part of said ball striking surface, said insert having a hollow interior defining an open-ended passageway extending therethrough from top to bottom to facilitate elastic flexing of said front grooved surface.

2. The golf club of claim 1 in which said insert is adhesively secured within said recess.

3. The golf club of claim 2 in which said insert is secured within said recess by means of an epoxy adhesive.

4. The golf club of claim 1 in which the upper and bottom edges of said insert are spaced slightly from the upper and lower walls defining said recess.

5. The golf club of claim 1 in which said passageway is substantially rectangular in horizontal cross-section.

6. The golf club of claim 1 in which said insert is composed of a metal having a minimum yield strength of 150,000 pounds per square inch.

7. The golf club of claim 6 in which said insert is composed of a precipitation hardening stainless steel.

8. The golf club of claim 6 in which said insert is composed of a beryllium-copper alloy.

9. A golf club of the wood type comprising a wooden head having a striking face on its front surface, said front surface having a recess formed therein, a polygonal metal insert having parallel substantially horizontal upper and lower edges and being adhesively secured within said recess and having a grooved outer surface forming a portion of said striking face, said insert being composed of a metal having a yield strength of at least 150,000 pounds per square inch, said insert having a hollow interior extending the full vertical dimension of said insert, said upper and lower edges of said insert being spaced slightly from the upper and lower walls defining said recess.

* * * * *